US006051767A

United States Patent [19]

Masubuchi

[11] Patent Number: 6,051,767

[45] **Date of Patent: *Apr. 18, 2000**

[54] KEYBOARD MUSICAL INSTRUMENT HAVING KEY INERTIA DEVICE

[75] Inventor: Takamichi Masubuchi, Hamamatsu, Japan

[73] Assignee: Yamaha Corporation, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/985,033

[22] Filed: Dec. 4, 1997

[30] Foreign Application Priority Data

Dec. 16, 1996 [JP] Japan ..... 8-335908

[51] Int. Cl.[7] ..... G10C 3/12

[52] U.S. Cl. ..... 84/423 R; 84/433

[58] Field of Search ..... 84/423 R, 433, 84/432, 434, 435, 439

[56] References Cited

U.S. PATENT DOCUMENTS

| | | | |
|---|---|---|---|
| 2,470,148 | 5/1949 | Demuth | 84/423 R |
| 2,844,065 | 7/1958 | Corwin | 84/423 R |
| 3,561,315 | 2/1971 | Ohno | 84/433 |
| 3,570,359 | 3/1971 | Ohno | 84/423 |
| 3,722,351 | 3/1973 | Allen et al. | 84/423 R |
| 4,240,321 | 12/1980 | Goldberg | 84/433 |
| 4,512,234 | 4/1985 | Kumano | 84/433 |
| 4,901,614 | 2/1990 | Kumano et al. | 84/1.1 |
| 5,574,241 | 11/1996 | Kumano et al. | 84/439 |
| 5,824,928 | 10/1998 | Kumano et al. | 84/423 R |
| 5,834,668 | 11/1998 | Kumano et al. | 84/423 R |

FOREIGN PATENT DOCUMENTS 4-172397 6/1992 Japan .

OTHER PUBLICATIONS

Merriam–Webster's Collegiate Dictionary, Tenth Edition, pp. 74, 440 and 441, 1997.

*Primary Examiner*—David Martin
*Assistant Examiner*—Kim Lockett
*Attorney, Agent, or Firm*—Pillsbury Madison & Sutro LLP

[57] ABSTRACT

A keyboard apparatus with at least one key having a rotation fulcrum and an exterior front end face on the opposite side of the rotation fulcrum in a performer side. The exterior front end face of the at least one key defines a front lower section. An extended section is provided at the front lower section of the at least one key that extends from the exterior front end face of the at least one key toward the performer side, and a mass member is attached to the extended section. The mass member therefore extends forwardly from the external front end face of the at least one key toward the performer side.

12 Claims, 3 Drawing Sheets

KEYBOARD MUSICAL INSTRUMENT HAVING KEY INERTIA DEVICE

BACKGROUND OF THE INVENTION

1. Field of the Invention

Embodiments of the present invention relate to a keyboard apparatus for an electronic keyboard musical instrument, such as an electronic organ, an electronic piano, a portable electronic keyboard apparatus, and the like.

2. Description of Related Art

U.S. Pat. No. 4,512,234 describes a keyboard apparatus for an electronic keyboard musical instrument that has a frame, at least one key rotatably supported by the frame so that the key is movable about a rotation fulcrum of the key, and a mass member (weight) disposed in the interior of the key. The mass member is disposed in the interior of the key at a place remote from the rotation fulcrum of the key and close to a front end of the key (which is adjacent an area where a player depresses the key).

By adding the mass member at a location closer to the front end of the key, a moment of inertia of the key is increased and thus the key touch feeling (the feeling of good resistance) sensed by the player is improved.

However, in order to obtain a good key touch feeling by increasing the moment of inertia of the key in the conventional keyboard apparatus, a relatively heavy mass member has to be added within the key, and such a measure causes various problems.

For example, the heavier the mass member, the larger the volume of the mass member. Therefore, a relatively large space has to be provided within each key and thus the degree of freedom in designing the keys and the structure around the keys is substantially restricted. As a result, reducing the size of a keyboard apparatus is difficult.

Also, when the mass member is heavier, the frame that supports the mass member must be accordingly stronger to resist the impact force that is generated when the key is depressed. As a result, the entire weight of the musical instrument increases, making it difficult to transport the musical instrument. Also, heavy packaging is required for protecting the musical instrument from impact forces that may be generated during transportation, resulting in a higher cost.

The heavier mass member is more expensive to produce, and there is extra cost incurred for securely and strongly mounting the heavy mass member to the key so that the mass member does not fall off the key during intense performances of the musical instrument.

SUMMARY OF THE INVENTION

It is an object of embodiments of the present invention to improve the key touch feeling without substantially increasing the weight of the mass member.

In accordance with an embodiment of the present invention, a keyboard apparatus has at least one key having a rotation fulcrum and an exterior front end face in the performer side which is opposite to the side of the rotation fulcrum, a frame for rotationally supporting the at least one key, and a mass member added to the at least one key to increase the moment of inertia of the key. The at least one key defines a front lower section adjacent the exterior front end face of the at least one key. An extended section is provided at the front lower section of the at least one key adjacent the external front end face of the at least one key, which extends from the exterior front end face of the at least one key toward the performer, and the mass member is attached to the extended section. In other words, the mass member extends forwardly from the external front end face of the at least one key.

With the structure described above, the mass member is located closer to the performer side front end of the keyboard apparatus than the exterior front end face of the at least one key, which is the remotest section of the at least one key from the key rotation fulcrum of the at least one key in the conventional keyboard apparatus. When the distance between the center of gravity of the mass member and the rotation fulcrum (rotation center) of the key is "L", and the weight of the mass member is M, the moment of inertia of the mass member equals $M \times L^2$. Therefore, as a result of the increased distance "L", the same moment of inertia is obtained by adding a lighter mass member, as compared with the conventional structure.

As a consequence, the mass member can be made lighter and smaller, and the above-described problems, that may occur when the moment of inertia of the at least one key is increased to generate a good key touch feeling, are alleviated.

The keyboard apparatus includes a key switch having a dome-shaped flexible member that is associated with the at least one key. The dome-shaped flexible member of the key switch includes a flexible protruded section. In a preferred embodiment, a returning force that is applied to the at least one key is provided by a resilient restoring force of the flexible protruded section of the dome-shaped flexible member of the key switch.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings.

DETAILED DESCRIPTION OF PREFERRED EMBODIMENTS

Embodiments of the invention will be described hereunder with reference to the accompanying drawings.

Figure 1:
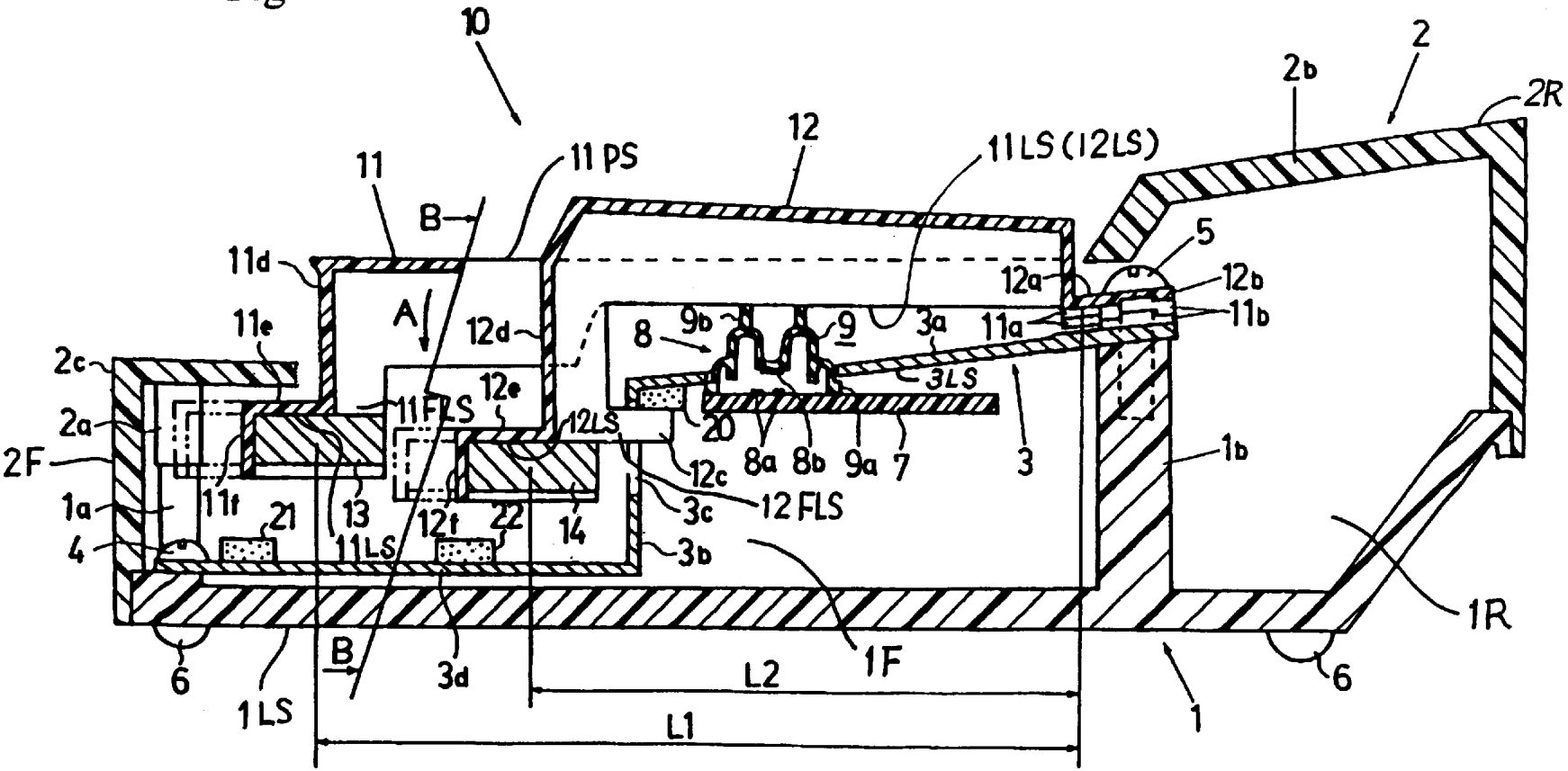
FIG. 1 is a cross-sectional view of an electronic keyboard musical instrument having a keyboard apparatus taken along a key length direction in accordance with an embodiment of the present invention.

FIG. 1 shows a cross-sectional view of an electronic musical instrument having a keyboard apparatus 10 taken along the key length direction of white and black keys in accordance with an embodiment of the present invention. More particularly, FIG. 1 shows a cross-sectional view of a black key on the right-hand side of a line B—B, and a cross-sectional view of a white key on the left-hand side of the line B—B.

The keyboard apparatus 10 includes a lower case 1 having an upwardly protruding boss 1*a* and an upper case 2 having a downwardly protruding boss 2*a*. The boss 1*a* and the boss 2*a* are brought into contact with each other and fixed together by screws (not shown) to form a housing for the keyboard apparatus 10. Each of the lower case 1 and the upper case 2 is integrally formed as a piece from a synthetic resin or the like. The upper case 2 defines a rear upper surface 2R and a front end 2F. The upper case 2 includes a control panel 2*b* provided on the rear upper surface 2R and a key slip 2*c* provided at the front end 2F. The lower case 1 defines a front section 1F and a rear section 1R.

A frame 3 is fixed between the front section 1F of the lower case 1 and an upwardly protruding boss 1*b* at the rear section 1R of the lower case 1 by screws 4 and 5. The frame 3 is preferably formed from a bent metal plate or a reinforced resin plate. Legs 6 are attached to areas adjacent to the four comers of a lower surface 1LS of the lower case 1. Legs 6 are made of a flexible material, such as, for example, rubber, synthetic rubber or the like.

A keyboard apparatus 10 is mounted on the frame 3. The keyboard apparatus 10 includes a plurality of white keys 11 and black keys 12 arranged in a predetermined order. The white keys 11 and the black keys 12 are exposed through a relatively large opening that is defined in the upper case 2 between the rear upper surface 2R and the front end 2F.

The white keys 11 and the black keys 12 include corresponding hinge sections 11*a* and 12*a*, respectively. A set of a plurality of the white keys 11 are connected to a coupling section 11*b* through the hinge sections 11*a*. The plurality of the white keys 11, the hinge sections 11*a* and the coupling section 11*b* for each of the sets are formed as a single piece from a synthetic resin or the like. A set of a plurality of the black keys 12 are connected to a coupling section 12*b* through the hinge sections 12*a*. The plurality of the black keys 12, the hinge sections 12*a* and the coupling section 12*b* for each of the sets are formed as a single piece from a synthetic resin or the like. The coupling sections 11*b* and 12*b* of each three sets (for example, two sets of the white keys 11 and one set of the black keys 12) are superimposed with one another to form a unit of white and black keys, and a plurality of the units are fixed to the boss 1*b* of the lower case 1 together with the frame 3 by screws 5.

In other words, the white keys 11 and the black keys 12 are rotatably supported by the frame 3 and the lower case 1 and rotatable in the direction of an arrow A (as shown in FIG. 1) about the respective hinge sections 11*a* and 12*a* which serve as rotation fulcrums (rotation centers).

A printed substrate 7, that incorporates a key switch circuit, is generally horizontally attached to a lower surface 3LS of a stepped-up section 3*a* of the frame 3. A plurality of key movement sensors are provided on the printed substrate 7 at locations opposing the respective white keys 11 and black keys 12. In the illustrated embodiment, each of the key movement sensors is formed from a key switch 8.

Each of the key switches 8 includes a base section 9*a* that is fixed to the printed substrate 7, a dome-shaped flexible member 9 having a depression section 9*b* that abuts a lower surface 11LS, 12LS of each of the white and black keys 11, 12, a pair of fixed contacts 8*a* that is formed on the printed substrate 7, and a movable contact 8*b* of a conductive rubber or the like that is formed in the interior and at the center of the dome-shaped flexible member 9.

The key switch 8 applies an upward returning force to each of the keys 11 and 12 by the resilient recovering force of the dome-shaped flexible member 9. When a key 11 or 12 is depressed, the associated dome-shaped flexible member 9 is elastically deformed, and the movable contact 8*b* contacts the fixed contacts 8*a* in the pair to short-circuit the fixed contacts 8*a*.

A stopper section 12*c*, that is rearwardly bent in the shape of a letter "L", is formed at a front lower section 12FLS of the black key 12. The stopper section 12*c* is passed through an opening 3*c* formed in a vertical section 3*b* of the frame 3 and extends under the frame 3, and abuts an upper stopper 20 that is made from a damping material, such as, for example, felt or the like. The upper stopper 20 is attached to the lower surface 3LS of the frame 3. The upper stopper 20 is commonly used for all of the keys, and restricts the upper most rising position of the black keys 12 in a non-key-depression state.

Each of the white keys 11 also has a similar stopper section (not shown) that is formed at the same location of the stopper section 12*c* of the black key 12 in the key-length direction. The stopper section of the white key 11 is also passed through the opening 3*c* defined in the frame 3 and abuts the upper stopper 20 that restricts the uppermost rising position of the white keys 11.

The white keys 11 have extended sections 11*e* provided at front lower sections 11FLS of the respective white keys 11. The black keys 12 also have extended sections 12*e* provided at the front lower sections 12FLS of the respective black keys 12. In the illustrated embodiment shown in FIG. 1, the extended section 12*e* of the black key 12 extends beneath performance sections 11PS of the two adjacent white keys 11. It is noted that the performance section 11PS of the white key 11 is an area where the performer's finger depresses the white key 11 for performance and is generally defined between the exterior front end 11*d* of the white key 11 and the exterior front end 12*d* of the black key 12. The extended sections 11*e* and 12*e* extend from exterior front ends 11*d* and 12*d* of the white key 11 and the black key 12, respectively, toward the front end 2F of the keyboard apparatus 10, which is also defined as a performer side (on the left side of FIG. 1). Mass members 13 and 14 are attached to lower sides 11LS and 12LS of the extended sections 11*e* and 12*e*, respectively, by adhesive, insertion coupling, screws, or the like. Preferably, the mass members 13 and 14 are made of a material having a relatively large specific gravity, such as, for example, lead, iron or the like.

It is noted that the exterior front ends 11*d* and 12*d* of the white key 11 and the black key 12 are exposed and thus visible from the performer. In other words, the exterior front ends 11*d* and 12*d* of the white key 11 and the black key 12 are exposed end faces of the white key 11 and the black key 12 on the performer side that are most remotely located from the respective hinge sections 11*a* and 12*a* that define rotation fulcrums.

A white key lower stopper 21 and a black key lower stopper 22, that are formed from a damping material, such as, for example, felt or the like, are provided on an upper surface of a stepped-down section 3*d* of the frame 3. Bent sections 11*f* and 12*f* downwardly extend from the respective extended sections 11*e* and 12*e* of the white key 11 and the black key 12. When the white key 11 and the black key 12 are depressed, the bent sections 11*f* and 12*f* abut the respective lower stoppers 21 and 22. The lower stoppers 21 and 22 restrict the lower most descending position of the respective white keys 11 and the black keys 12.

The mass members 13 and 14 are attached at the lower surfaces 11LS and 12LS of the extended sections 11*e* and 12*e* that extend toward the performer side from the exterior front ends 11*d* and 12 of the respective white keys 11 and the black keys 12.

When the weight of each of the mass members 13 and 14 is M1 and M2, respectively, and the horizontal distance between the center of gravity of each of the mass members 13 and 14 and the rotation center of each of the white key 11 and the black key 12 (which are presumably located at the center of each of the hinge section 11*b* and the hinge section 12*b*) is L1 and L2, respectively, the moment of inertia of the white key 11 is increased by the mass member 13 by an amount of $M1 \times L1^2$ and the moment of inertia of the black key 12 is increased by the mass member 14 by an amount of $M2 \times L2^2$.

The distances L1 and L2 in the above embodiment are greater than those of a conventional keyboard apparatus of a similar type in which a mass member is provided within a key and interior of an exterior front end of the key. As a result, the weight of the mass members 13 and 14 in accordance with the embodiments of the present invention can be smaller as compared with the conventional type to gain sufficient moment of inertia. As a consequence, the key touch feeling is improved and the above-described problems associated with the increased weight of the mass member are thus alleviated.

The mass members 13 and 14 are preferably added to all of the respective white keys 11 and the black keys 12 at a location that is extended from the exterior front ends 11*d* and 12*d* of the white keys 11 and the black keys 12 toward the front end 2F of the keyboard apparatus 10 in the performer side. Alternatively, the above-described mass-member structure can be implemented in either of the white keys 11 or the black keys 12. In particular, since the black key 11 is shorter than the white key 12 in an ordinary keyboard apparatus, and the black key 11 cannot be made substantially longer than a typical black key length of the generally accepted standard with respect to the white key, mounting the mass member 14 at the extended section 12*e* of the black key 12 effectively increases the moment of inertia. Moreover, since the extended section 12*e* of the black key 12 can be extended in a space beneath the performance sections 11PS of the adjacent white keys 11, the space is more effectively utilized and the entire size of the keyboard apparatus 10 does not have to be enlarged for the extended sections 12*e* of the black keys 12.

In accordance with an alternative embodiment, the key switches 8 are disposed between the stepped-down section 3*d* of the frame 3 and the extended sections 11*e* and 12*e* of the white keys 11 and the black keys 12 or the mass members 13 and 14 attached to the white keys 11 and the black keys 12. As a result, the stroke of the switch operation upon key depression becomes greater, and thus the switch sensitivity or the switch resolution is improved. Also, since a smaller force is required to return the keys 11 and 12, the dome-shaped resilient member 9 can have a smaller flexible recovering force. As a result, the durability of the dome-shaped resilient member 9 is improved.

In other embodiments, the returning force to be applied to each of the keys 11 and 12 may be provided by the resilient force of each of the hinge sections 11*b* and 12*b*, or the returning force may be provided by a key returning spring (not shown) that is independent of the key switch 8. Also, key switches having other structures can be used.

Figure 2:
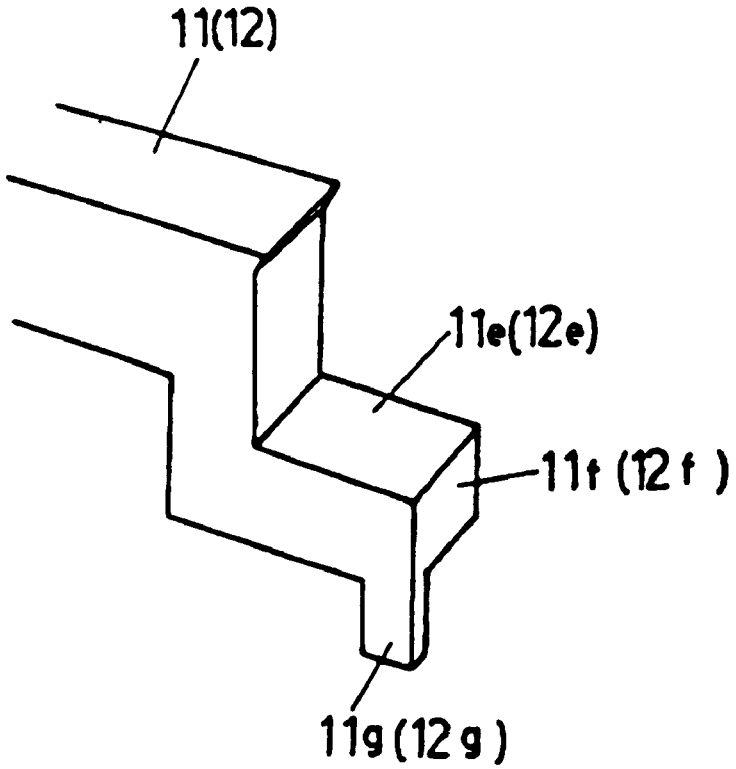
FIG. 2 is a perspective view of a front end section of a key in which the embodiment shown in FIG. 1 is partially modified.
Figure 3:
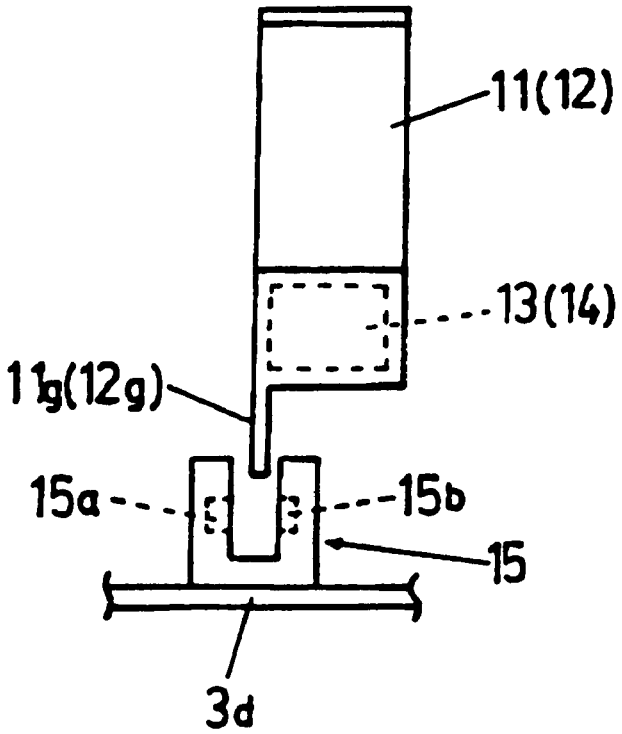
FIG. 3 is a partial front view of the key shown in FIG. 2 and an optical sensor.

In accordance with an embodiment of the present invention as shown in FIG. 2, the extended section 11*e* (12*e*) of the key 11 (12) is provided at its front end with a protruded section 11*g* (12*g*) that extends further downwardly from the bent section 11*f* (12*f*). As shown in FIG. 3, an optical sensor 15 having opposing light emitting element 15*a* and light receiving element 15*b* is disposed on the stepped-down section 3*d* of the frame 3. The protruded section 11*g* (12*g*) in its descending stroke is positioned between the light emitting element 11*a* and the light receiving element 15*b* so that the optical sensor 15 detects a key depression of the key 11 (12) or preferably detects an entire key depression stroke of the key 11 (12).

In the above embodiment, the protruded section 11*g* (12*g*) is disposed at a location that is most remotely located from the rotation center of the key 11 (12). As a result, the largest key depression stroke along the key-length of the key 11 is obtained, and therefore the detection sensitivity by the optical sensor 15 is increased.

Figure 4:
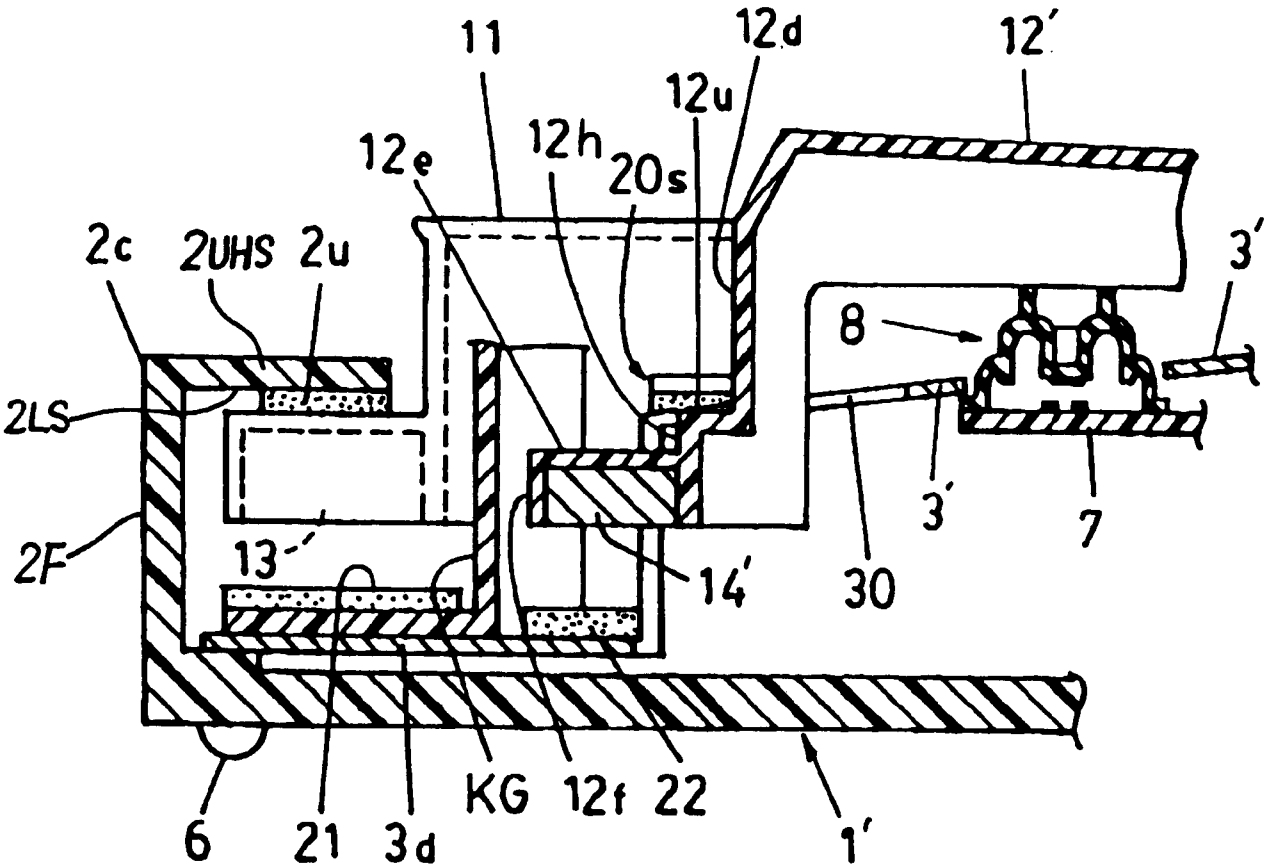
FIG. 4 is a cross-sectional view of a front half of an electronic musical instrument taken along a key length direction in accordance with another embodiment of the present invention.

FIG. 4 shows a cross-sectional view of a front half section of an electronic keyboard musical instrument having a keyboard apparatus 10' taken along the key length direction in accordance with another embodiment of the present invention. Reference numerals that are the same as those used in FIG. 1 denote the same elements shown in FIG. 1, and thus the description of these elements is omitted. It is noted that reference numerals with apostrophes denote elements which are partially modified but similar to those shown in FIG. 1.

In the embodiment shown in FIG. 4, a front end section of each black key 12' and an upper limit stopper for a black key 12' are different from those shown in FIG. 1. Also, a key guide member KG is additionally provided in the embodiment shown in FIG. 4. A lower case 1' has substantially the same structure as the one shown in FIG. 1 except that a key slip 2C is integrally formed with the lower case 1'.

A black key 12' has an exterior front end 12*d* and is provided with an upper stopper protruded section 12*h* that forwardly protrudes from the exterior front end 12*d*. The upper stopper protruded section 12*h* defines an upper stopper section 12*u*.

An extended section 12*e* forwardly extends from the protruded section 12*h* toward the performer side of the keyboard apparatus 10, and a mass member 14' is fixed inside the extended section 12*e* with glue or the like. The extended section 12*e* and the mass member 14' provide the same function which is generated by the extended section 12*e* and the mass member 14 shown in FIG. 1.

External side surfaces of the extended section 12*e* in the key width direction define sections to be guided by a key guide section KG that extends from the top surface of the stepped-down section 3*d*. The key guide section KG has a channel shaped cross-section in the horizontal direction that defines an internal channel surface. Both of the external side surfaces of the extended section 12*e* are slidably guided by the internal channel surface of the key guide section KG.

A stopper member 21 for the white key 11 is disposed on an upper surface of the key guide section KG which is disposed on the stepped-down section 3*d*. The stopper member 21 stops the white key 11 as the white key 11 is depressed and functions as a lower stopper that limits the lowermost descending position of the white key 11. An upper limit stopper member 2*u* is attached by adhesive to a lower surface 2LS of an upper horizontal section 2UHS of the key slip 2C.

An upper stopper member 20*s* for the black key 12' preferably has a multi-layered plate structure, including a lower layer of felt and an upper layer of metal. The upper stopper member 20*s* is attached by adhesive to a lower surface of a frame 3' and then fastened by screws (not shown). The black keys 12' are inserted through a relatively large aperture 30 defined in the frame 3' and mounted on the frame 3'.

The keyboard apparatus 10' having the structure described above and shown in FIG. 4 achieves substantially the same objects and effects that are achieved by the above-described embodiment shown in FIG. 1. The mass member 14' may be disposed at any location in an area that extends from the exterior front end 12*d* of the key 12' toward the performer side. The mass member 14' may also be connected through an additional functional member, such as, for example, the upper stopper section 12*u* that is located between the exterior front end 12*d* of the key12' and the mass member 14'. In other words, when an additional functional member (such as, for example, the upper stopper section 12*u* and the like) is disposed adjacent the exterior front end 12*d* of the key 12', the mass member 14' is preferably disposed at a free end of the functional member in an area closer to the front end 2F of the keyboard apparatus. As a result, the arm of rotational moment force becomes longer, and the mass member 14 can accordingly be made lighter.

As described above, the mass member 14' is disposed in an area that forwardly extends from the exterior front end 12*d* of the key 12' toward the performer side. As a result, the key depression guide sections KG for the black keys 12' and the key depression guide sections KG for the white keys 11 are disposed on the same line extending in the key arrangement direction. Accordingly, the structure of the key guide section is simplified.

It is noted that the guide sections are not provided in the embodiment shown in FIG. 1 because each key fulcrum section of a key that rotatably supports the key is substantially wider in the key width direction so that the key is allowed to move in the key depression direction but is substantially prevented from moving in the key width direction. As a result, such guide sections to guide the keys in the vertical direction are not required.

The keyboard apparatuses in accordance with the embodiments of the present invention described above with reference to FIGS. 1–4 are incorporated in a small portable electronic keyboard musical instrument. However, the keyboard apparatuses in accordance with various embodiment of the present invention can also be applicable to a variety of other types of electronic keyboard musical instruments.

In the keyboard apparatuses in accordance with the embodiments described above, a mass member that is added to each key is lighter in weight than the conventional type but creates an increased moment of inertia sufficient to improve the key touch feeling. As a result, the present invention alleviates a variety of problems associated with an increased weight and volume of a mass member. Accordingly, the degree of freedom in designing the keyboard apparatus is increased, the overall size and weight of a keyboard apparatus is further reduced, the transportability is improved, and the manufacturing cost is reduced.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A keyboard apparatus defining a performer side, the keyboard apparatus comprising:

at least one key having a rotational fulcrum and an exterior front end opposing the rotational fulcrum, the exterior front end having a front lower section;

a frame that rotationally supports the at least one key about the rotational fulcrum thereof;

an extended section provided at the front lower section of the at least one key, the extended section extending from the exterior front end of the at least one key toward the performer side and away from the rotational fulcrum along a substantially horizontal plane; and a mass member immovably attached to the extended section to increase a moment of inertia of the at least one key, wherein at least a part of the mass member protrudes toward the performer side beyond a plane formed by the exterior front end.

2. A keyboard apparatus as set forth in claim 1, further comprising a lower stopper disposed on the frame for limiting a lower most descending position of the at least one key, wherein the extended section includes an abutting section that abuts the lower stopper.

3. A keyboard apparatus as set forth in claim 2, wherein the lower stopper is formed from a damper material.

4. A keyboard apparatus as set forth in claim 3, wherein the damper material is felt.

5. A keyboard apparatus as set forth in claim 1, further comprising a lower stopper disposed on the frame for limiting a lowermost descending position of the at least one key, wherein the mass member includes an abutting section that abuts the lower stopper.

6. A keyboard apparatus as set forth in claim 5, wherein the lower stopper is formed from a damper material.

7. A keyboard apparatus as set forth in claim 6, wherein the damper material is felt.

8. A keyboard apparatus defining a performer side, the keyboard apparatus comprising:

at least one black key having a rotational fulcrum and an exterior front end opposing the rotational fulcrum, the exterior front end having a front lower section;

a frame that rotationally supports the at least one black key about the rotational fulcrum thereof;

an extended section provided at the front lower section of the at least one black key, the extended section extending from the exterior front end of the at least one black key toward the performer side and away from the rotational fulcrum along a substantially horizontal plane;

a mass member immovably attached to the extended section of the at least one black key to increase a moment of inertia of the at least one black key, wherein at least a part of the mass member protrudes toward the performer side beyond a plane formed by the exterior front end; and at least two adjacent white keys disposed on both sides of the at least one black key, each of the at least two white keys having a rotational fulcrum, an exterior front end opposing the rotational fulcrum and a performance section generally defined between the exterior front end of the at least one black key and the exterior front end of each of the at least two white keys, wherein the extended section of the at least one black key extends beneath adjacent performance sections of the at least two white keys.

9. A keyboard apparatus defining a performer side, the keyboard apparatus comprising:

at least one black key having a rotational fulcrum and a first exterior front end opposing the rotational fulcrum, the first exterior front end having a first front lower section;

a first extended section provided at the first front lower section of the at least one black key, the first extended section extending from the first exterior front end of the at least one black key toward the performer side and away from the rotational fulcrum along a substantially horizontal plane;

a first mass member immovably attached to the first extended section of the at least one black key to increase a moment of inertia of the at least one black key, wherein at least a part of the first mass member protrudes toward the performer side beyond a plane formed by the exterior front end;

at least two adjacent white keys disposed on both sides of the at least one black key, each of the at least two white keys having a second exterior front end defining a second front lower section and a rotational fulcrum opposing the second exterior front end;

a second extended section provided at the second front lower section of each of the at least two white keys, the second extended section extending from the second exterior front end of each of the at least two white keys toward the performer side and away from the rotational fulcrum along a substantially horizontal plane; and a second mass member immovably attached to the second extended section of each of the at least two white keys to increase the moment of inertia of each of the at least two white keys, wherein at least a part of the second mass member protrudes toward the performer side beyond a plane formed by the exterior front end.

10. A keyboard apparatus as set forth in claim 9, wherein each of the at least two white keys has a performance section generally defined between the first exterior front end of the at least one black key and the second exterior front end of each of the at least two white keys, wherein the first extended section of the at least one black key extends beneath adjacent performance sections of the at least two white keys.

11. A keyboard apparatus as set forth in claim 9, further comprising a first lower stopper disposed on a frame for limiting a lowermost descending position of the at least one black key, a second lower stopper disposed on the frame for limiting a lowermost descending position of each of the at least two white keys, a first abutting section provided adjacent the first extended section for abutting the first lower stopper, and a second abutting section provided adjacent the second extended section for abutting the second lower stopper.

12. A keyboard apparatus as set forth in claim 10, further comprising a first lower stopper disposed on a frame for limiting a lowermost descending position of the at least one black key, a second lower stopper disposed on the frame for limiting a lowermost descending position of each of the at least two white keys, a first abutting section provided adjacent the first extended section for abutting the first lower stopper, and a second abutting section provided adjacent the second extended section for abutting the second lower stopper.

* * * * *